US012072120B2

(12) United States Patent
Haddeman et al.

(10) Patent No.: US 12,072,120 B2
(45) Date of Patent: Aug. 27, 2024

(54) AIR DIFFUSER DEVICE FOR VENTILATING ROOMS

(71) Applicant: ZEHNDER GROUP INTERNATIONAL AG, Graenichen (CH)

(72) Inventors: Martijn Haddeman, PN Epe (NL); Remco Walta, RW Steenwijkerwold (NL); Peter Willering, EH Zwolle (NL); Paul Oteman, EK Deventer (NI); Elmer Curcho Mendivelso, CB Zwolle (NL)

(73) Assignee: ZEHNDER GROUP INTERNATIONAL AG, Gränichen (CH)

( * ) Notice: Subject to any disclaimer, the term of this patent is extended or adjusted under 35 U.S.C. 154(b) by 334 days.

(21) Appl. No.: 16/481,894

(22) PCT Filed: Jan. 30, 2018

(86) PCT No.: PCT/IB2018/000046
§ 371 (c)(1),
(2) Date: Jul. 30, 2019

(87) PCT Pub. No.: WO2018/138573
PCT Pub. Date: Aug. 2, 2018

(65) Prior Publication Data

US 2021/0302059 A1 Sep. 30, 2021

(30) Foreign Application Priority Data

Jan. 30, 2017 (CH) ..... 0014617

(51) Int. Cl.
*F24F 13/08* (2006.01)
*F24F 7/04* (2006.01)
(Continued)

(52) U.S. Cl.
CPC ..... *F24F 13/08* (2013.01); *F24F 7/04* (2013.01); *F24F 11/74* (2018.01); *F24F 13/062* (2013.01); *F24F 13/24* (2013.01)

(58) Field of Classification Search
CPC .... F24F 13/08; F24F 11/74; F24F 7/04; F24F 13/062; F24F 13/24; F24F 13/06
(Continued)

(56) References Cited

U.S. PATENT DOCUMENTS 2,209,121 A 7/1940 Fredrich
2,387,080 A * 10/1945 Lundberg ..... F02M 35/022 96/348
(Continued)

FOREIGN PATENT DOCUMENTS

CN 105928169 A 9/2016
DE 102006053392 A1 * 5/2008 ..... F24F 13/06
(Continued)

OTHER PUBLICATIONS

Definition of "Inflection," Oxford English Dictionary, Oxford University Press, 2022 (Year: 2022).*
(Continued)

*Primary Examiner* — Edelmira Bosques
*Assistant Examiner* — Brett Peterson Mallon
(74) *Attorney, Agent, or Firm* — Pauley Erickson & Swanson

(57) ABSTRACT

The invention relates to an air diffuser device (1) for ventilating rooms and to be installed in a ventilation duct opening in a wall or ceiling of a room, said air diffuser device (1) comprising a baffle element (10) having a central region (10*a*) and a peripheral region (10*b*) with a peripheral edge (12; 13) for deviating at least a part of a ventilation air flow entering said room through said ventilation duct opening in a flow direction with an air flow component parallel
(Continued)

to said wall or ceiling. The baffle element (10) comprises a plurality of slits or grooves (11) each extending from the central region (10*a*) of said baffle element (10) to the peripheral region (10*b*) of said baffle element (10). In addition, the peripheral edge (13) of said baffle element (10) has a plurality of radially extending indentations (14) spaced from each other along the periphery of said baffle element (10).

18 Claims, 14 Drawing Sheets

(51) Int. Cl.
*F24F 11/74* (2018.01)
*F24F 13/062* (2006.01)
*F24F 13/24* (2006.01)

(58) Field of Classification Search
USPC ..... 454/329, 300, 310, 311, 312
See application file for complete search history.

(56) References Cited

U.S. PATENT DOCUMENTS 2,407,284 A * 9/1946 Kennedy ..... F24F 13/062 236/49.5
2,504,472 A * 4/1950 Van Alsburg ..... F24F 13/062 454/302
2,560,874 A 7/1951 Frank
2,796,821 A 6/1957 Walpole
3,205,809 A * 9/1965 Sweeney ..... F24F 13/06 454/300
2,772,624 A * 12/1965 Carnes ..... F24F 13/062 454/312
3,299,797 A * 1/1967 Dry ..... F24F 13/062 454/295

FOREIGN PATENT DOCUMENTS

EP 0595756 A1 5/1994
FI 92527 B * 8/1994 ..... F24F 11/74
GB 1432146 A * 4/1976 ..... F24F 13/062
KR 100943858 B1 2/2010
KR 20160087406 A 7/2016

OTHER PUBLICATIONS

Soethe, et al., DE 102006053392 A1 English machine translation, May 15, 2008 (Year: 2008).*
English translation of FI-92527-B, dated Jul. 28, 2023 (Year: 2023).*
International Search Report of May 11, 2018 for PCT/IB2018/000046.

* cited by examiner

*Section A-A*

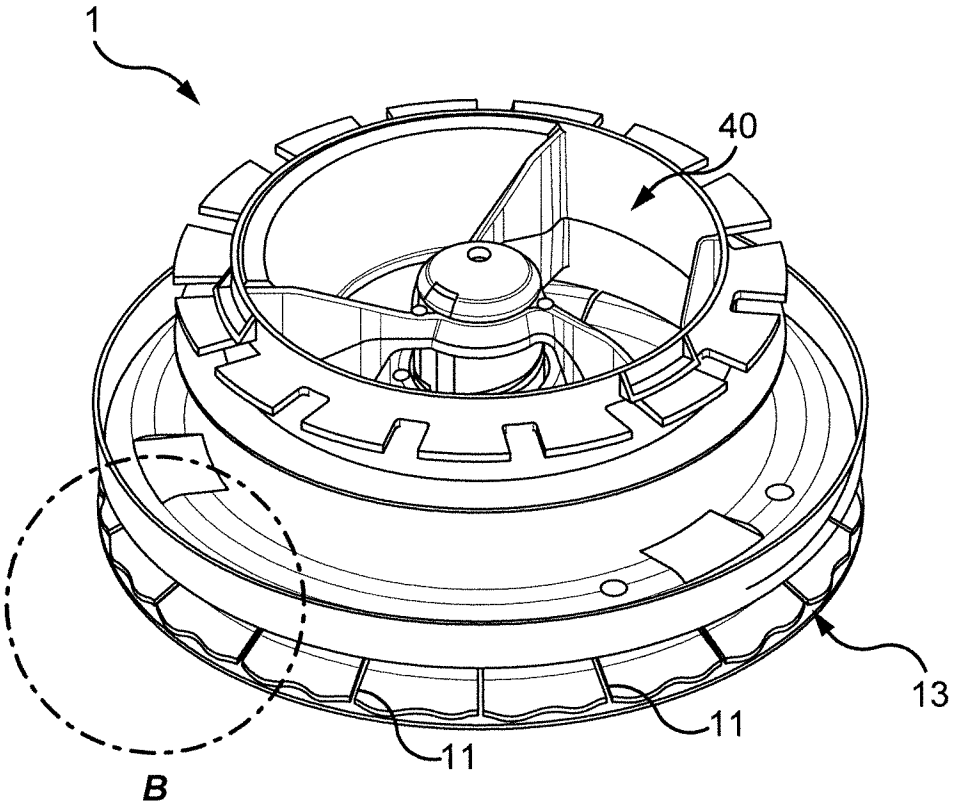
FIG. 1 Continued
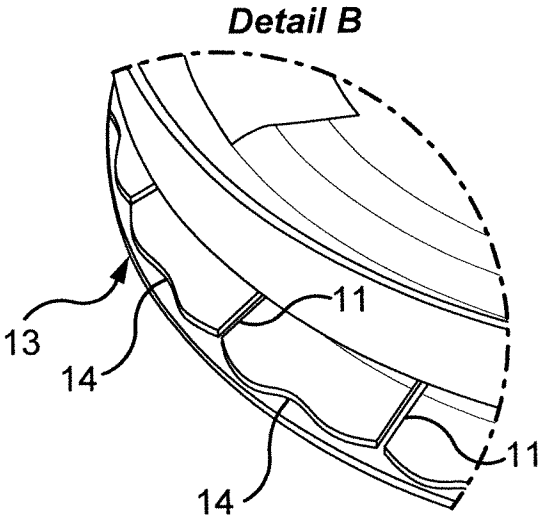

Section Z-Z

AIR DIFFUSER DEVICE FOR VENTILATING ROOMS

The present invention relates to an air diffuser device for ventilating rooms and to be installed in a ventilation duct opening in a wall or ceiling of a room.

Such devices are known for example from US617677 or U.S. Pat. No. 3,299,797.

A common problem found in such air diffuser devices is noise caused by air flow through the devices.

It is an object of the present invention to reduce or modify all sorts of noises caused by air flow through such an air diffuser device and prone to be a nuisance to persons in a room provided with such an air diffuser device.

According to a first aspect of the present invention, this object is achieved by an air diffuser device for ventilating rooms and to be installed in a ventilation duct opening in a wall or ceiling of a room, said air diffuser device comprising a baffle element having a central region and a peripheral region with a peripheral edge for deviating at least a part of a ventilation air flow entering said room through said ventilation duct opening in a flow direction with an air flow component parallel to said wall or ceiling, characterized in that said baffle element comprises a plurality of slits or grooves each extending from the central region of said baffle element to the peripheral region of said baffle element.

It has been surprisingly found that air flowing through such an air diffuser device causes less or even hardly any noise at least in the human audible spectrum.

In addition, vertical air flows causing draft and discomfort can be avoided.

Preferably, said baffle element comprises peripherally open slits or grooves which are open at the peripheral edge of said baffle element. This slit or groove geometry causes little turbulence in the air passing along the baffle element with a radial flow pattern from a center to the periphery of the baffle element.

Alternatively, said baffle element may comprise peripherally closed slits each having a bridge portion in the peripheral region for bridging the gap at the peripheral end of each slit. Such bridge portions increase the rigidity of the baffle element and may be used in cases where the baffle element has a small thickness.

Preferably, said baffle element comprises only peripherally open slits which are open at the peripheral edge of said baffle element. As mentioned above, such open slits tend to produce little turbulence in the air flowing along the baffle element.

According to a second aspect of the present invention, this object is achieved by an air diffuser device, preferably comprising the features of the diffuser device according to the first aspect of the present invention, wherein the peripheral edge of said baffle element has a plurality of radially extending indentations spaced from each other along the periphery of said baffle element.

Again, it has been surprisingly found that air flowing through such an air diffuser device causes less or even hardly any noise at least in the human audible spectrum.

The indentations may be spaced at regular or irregular intervals along the periphery of said baffle element.

The peripheral edge of said baffle element may have a zigzag-like or sawtooth-like contour.

Alternatively, the peripheral edge of said baffle element may have a wave-like or sinusoidally-shaped contour.

Preferably, said indentations form a contour line extending along the circumference of the baffle element, the maximum depth of said indentations being between 1/60 and 1/10, preferably between 1/50 and 1/30, of the average radial extension of the baffle element. With these dimensions, a significant noise reduction can be achieved.

Preferably, the air diffuser device further comprises a mounting element for mounting said baffle element to a ventilation duct.

The mounting element and said baffle element may be connected to each other in the central region and/or in the peripheral region of said baffle element.

Preferably, the mounting element and said baffle element are formed integrally, i.e. in one piece as a monobloc.

Alternatively, if the mounting element and the baffle element are not formed integrally, said mounting element may have first formations and said baffle element may have second formations, said first and second formations being complementary to each other for connecting said baffle element to said mounting element.

Preferably, said mounting element and said baffle element are connected adjustably with respect to each other.

Preferably, the contour of said baffle element along a radial direction from the central region to the peripheral region of said baffle element has a point of inflexion defining a change in curvature from a radially internal curvature region to a radially external oppositely curved curvature region of said baffle element. Again, it has been surprisingly found that this contributes to achieving less or even hardly any noise at least in the human audible spectrum.

Preferably, the contour of said baffle element along a radial direction from the central region to the peripheral region of said baffle element is substantially S-shaped.

Preferably, the point of inflexion is located at a radial position along the baffle element contour, wherein the radial extension of the radially external curved region of said baffle element is less than the radial extension of the radially internal curved region of said baffle element. Again, this contributes to achieving less or even hardly any noise at least in the human audible spectrum.

More preferably, the point of inflexion is located at a radial position along the baffle element contour such that the radial extension of the radially external curved region of said baffle element is between 1/10 and 1/3, preferably between 1/8 and 1/4, of the radial extension of the radially internal curved region of said baffle element.

Preferably, said baffle element is a first baffle element and said air diffuser device further comprises a second baffle element located at a position upstream of said first baffle element.

Preferably, said baffle element is rotationally symmetric with respect to an axis extending across the center point of its central region.

Preferably, said second baffle element is rotationally symmetric with respect to an axis extending across the center point of its central region.

In a very advantageous embodiment, the axial spacing (distance) between said second baffle element and said first baffle element is adjustable. As a result, the air gap and thus the flow resistance of the diffuser device may be adjusted.

Preferably, at least one of said first and second baffle elements is threadably mounted by a thread element having as its thread axis the axis extending across the center point of the central region of said first and second baffle elements. This allows a continuous adjustment of the gap.

Preferably, at least one of said first and second baffle elements has angularly spaced surface markings positioned along a circle having as its center the center point of the central region of said first and second baffle elements.

Preferably, the axial spacing (distance) between said second baffle element and said first baffle element is manually adjustable.

In a very advantageous embodiment, the air diffuser device comprises an adjustment and locking element for locking the adjusted axial spacing (distance) between said second baffle element and said first baffle element. As a result, a well-defined gap can be maintained.

Alternatively, the air diffuser device may comprise a drive element (31) for adjusting the axial-spacing (distance) between said second baffle element and said first baffle element.

A further advantage of the air diffuser device according to the invention, when mounted at a ceiling opening or at a wall opening, is the fact that less air is directed to the ceiling or to the wall, thus causing less pollution on the ceiling.

Further applications, features and advantages provided by the present invention will become more apparent from the following description and the drawings.

Figure 1:
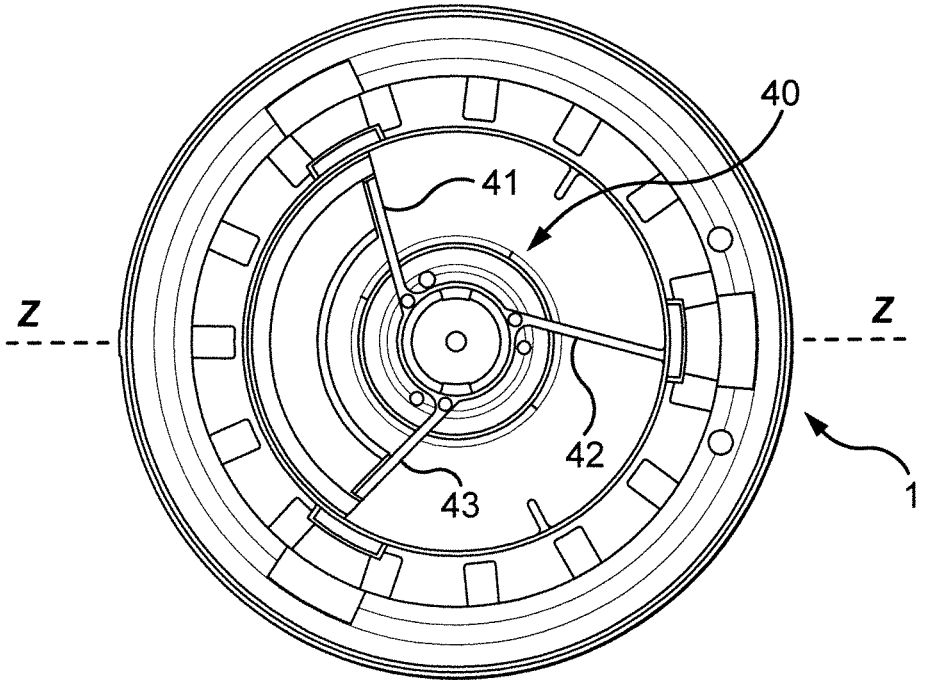
FIG. 1 shows several views of a preferred embodiment of the air diffuser device of the present invention.
Figure 1:
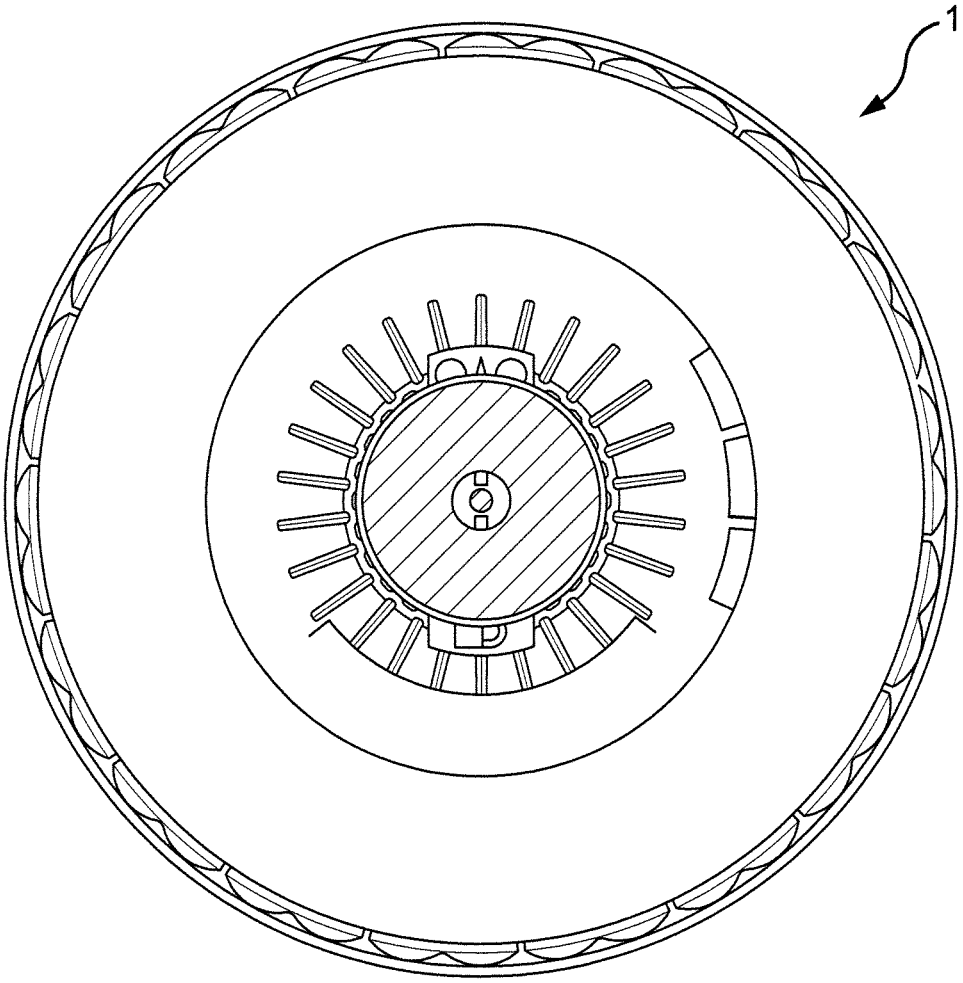
Figure 1:
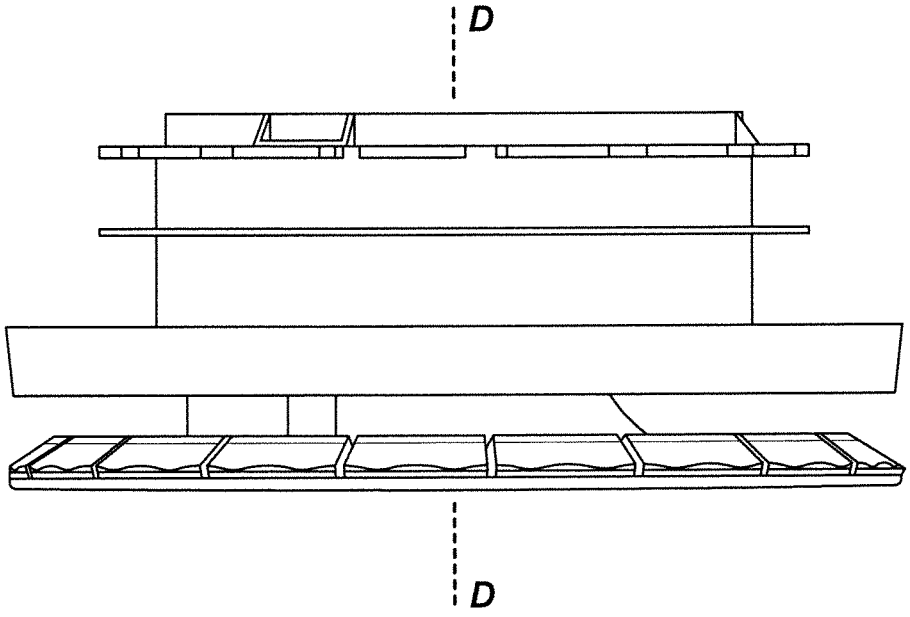
Figure 1:
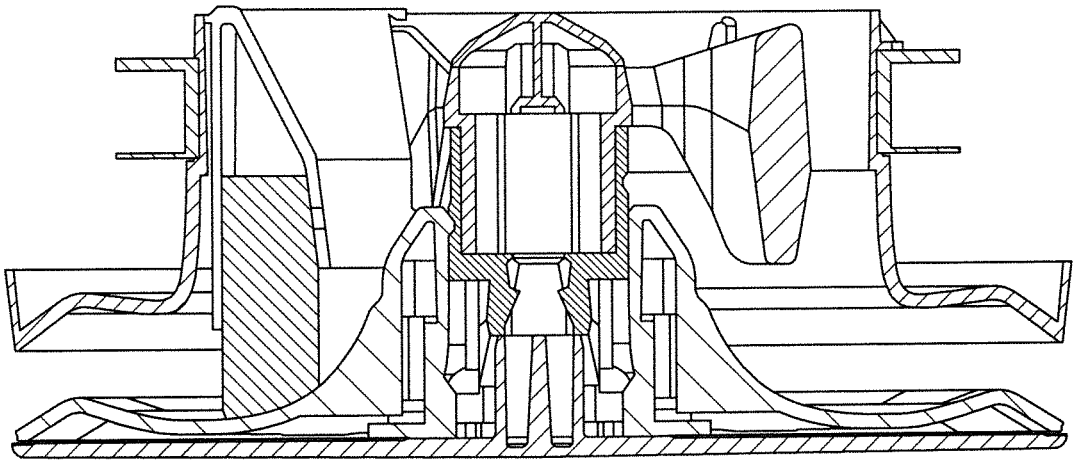
Figure 1:
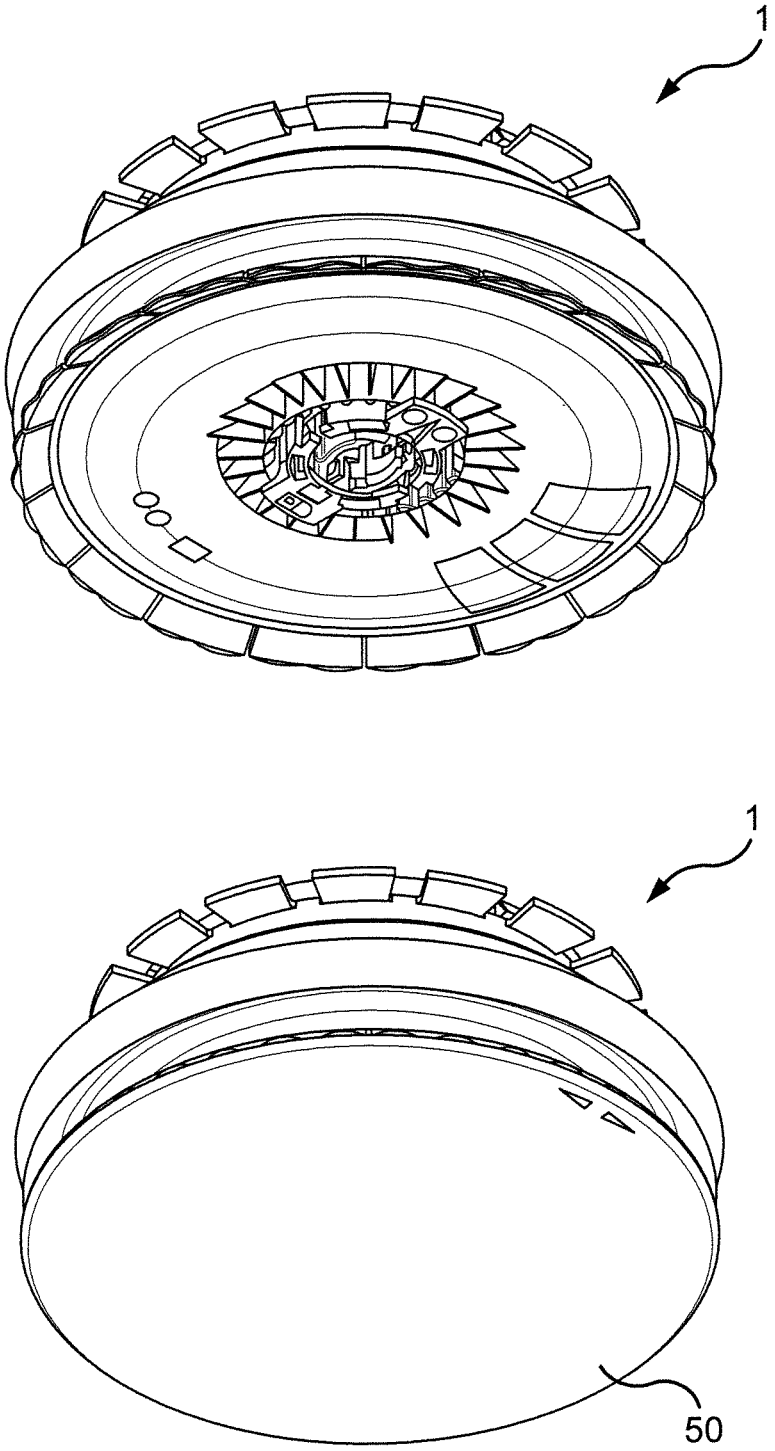
Figure 1:
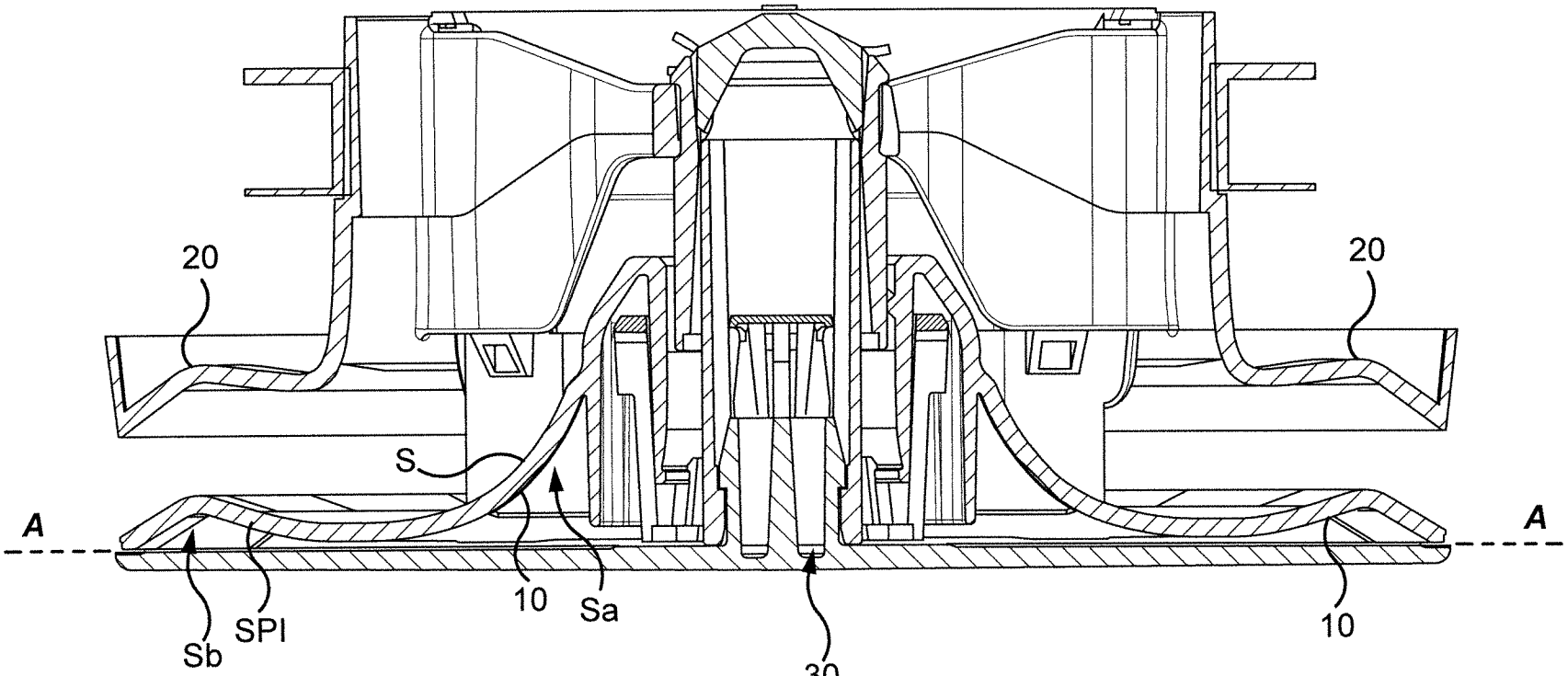

In FIG. 1, an air diffuser device 1 for ventilating rooms and to be installed in a ventilation duct opening in a wall or ceiling of a room is shown. The air diffuser device 1 comprises a first baffle element 10 having a central region 10*a* and a peripheral region 10*b* with a peripheral edge 12/13 for deviating at least a part of a ventilation air flow entering said room through said ventilation duct opening in a flow direction with an air flow component parallel to said wall or ceiling. The baffle element 10 comprises a plurality of slits or grooves 11 each extending from the central region 10*a* of said baffle element 10 to the peripheral region 10*b* of said baffle element 10. In addition, the air diffuser device 1 has a peripheral edge 13 of said baffle element 10 having a plurality of radially extending indentations 14 spaced from each other along the periphery of said baffle element 10. The indentations 14 are spaced at regular intervals along the periphery 10*b* of said baffle element 10. The peripheral edge 10*b* of said baffle element 10 has a wave-like or sinusoidally-shaped contour at its periphery 10*b*. In addition, the air diffuser device 1 comprises a second baffle element 20. Between the two baffle elements 10 and 20 a gap is defined. The air diffuser 1 also comprises a fan element 40 having a first fan blade 41, a second fan blade 42 and a third fan blade 43.

Figure 2:
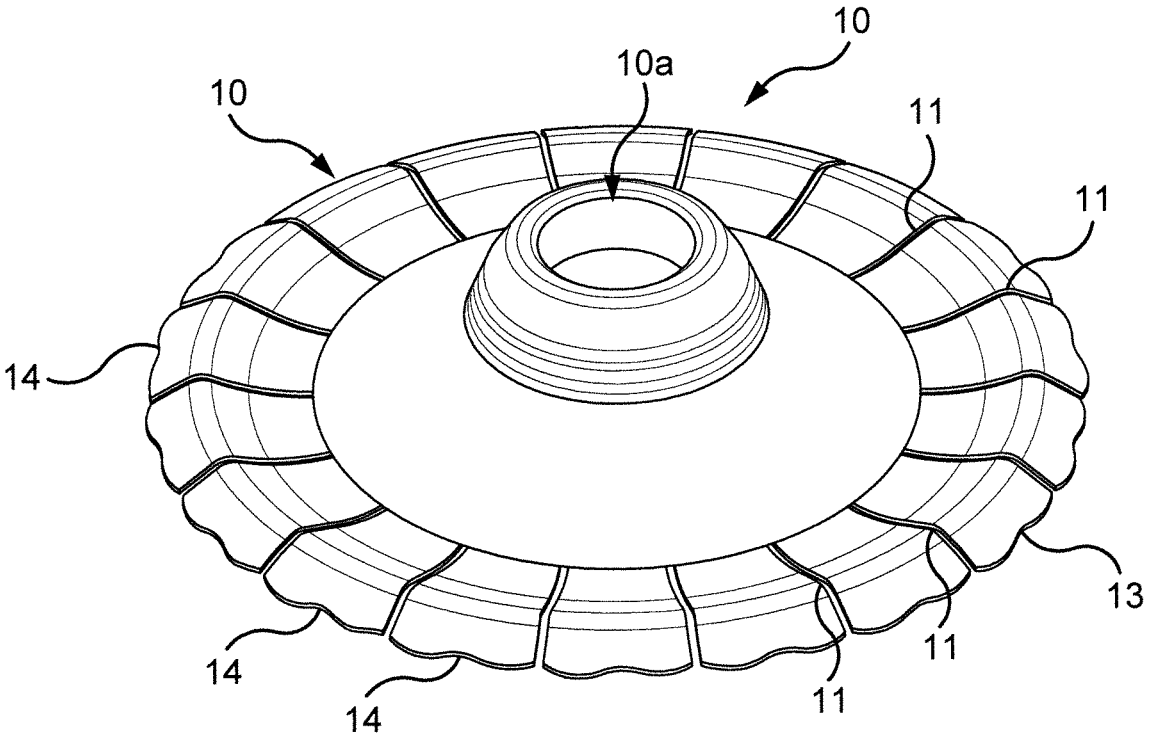
FIG. 2 shows several views of a component of the preferred embodiment of the air diffuser device shown in FIG. 1.
Figure 2:
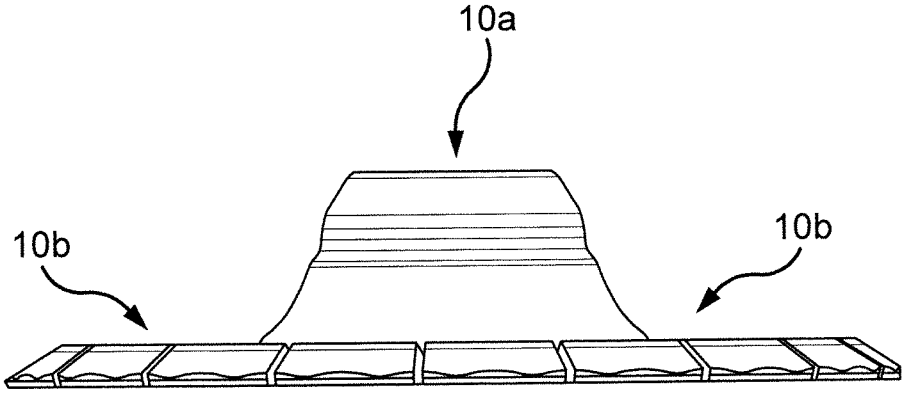
Figure 2:
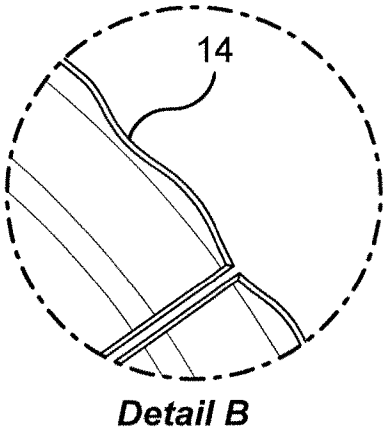
Figure 2:
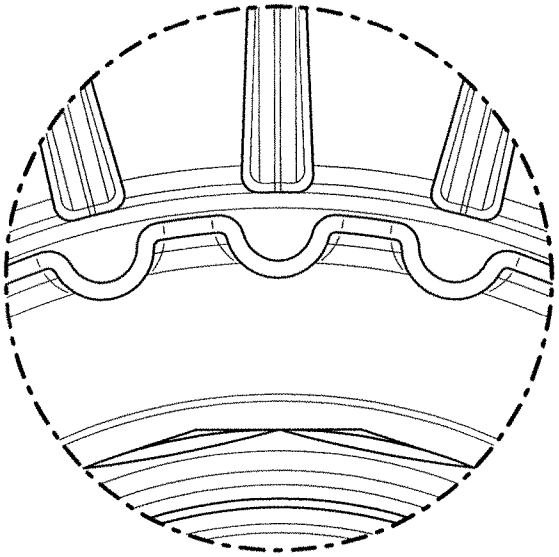
Figure 2:
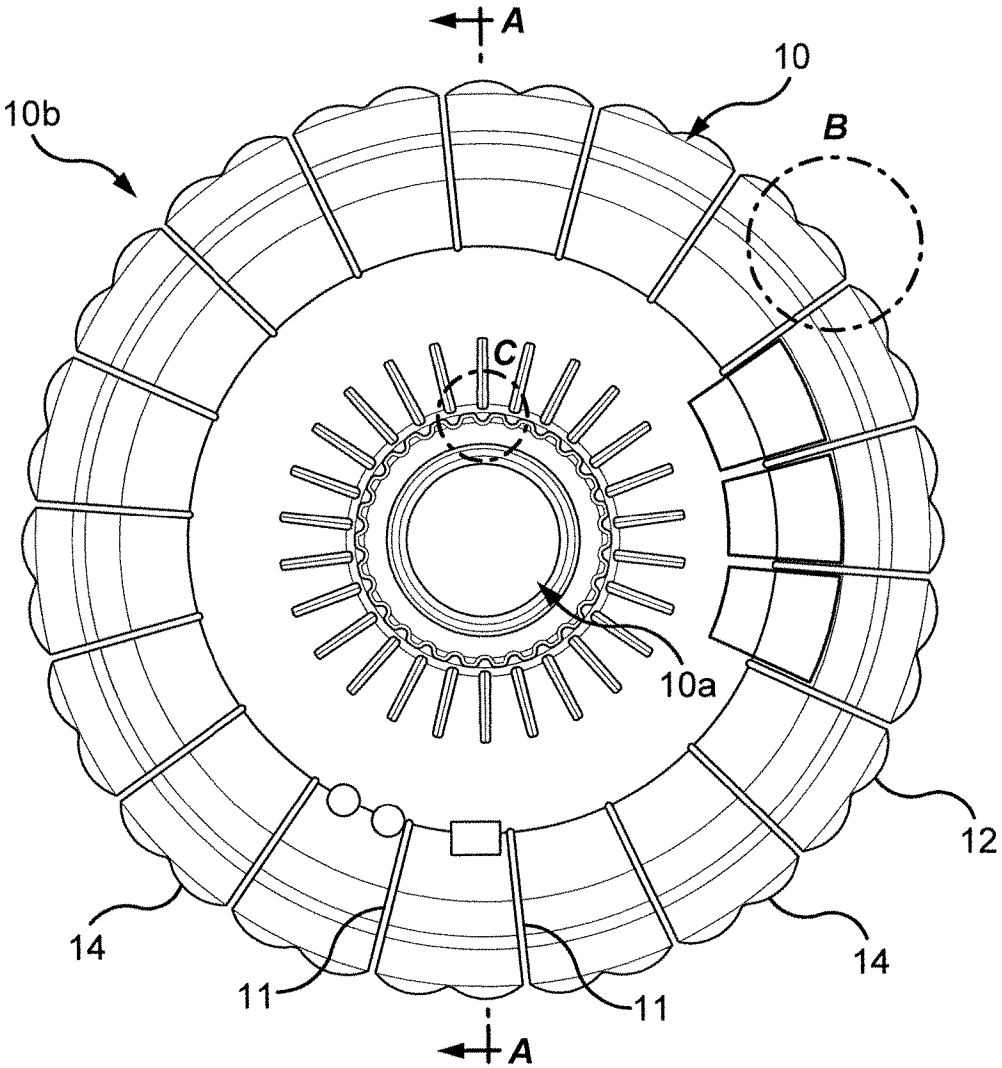
Figure 2:
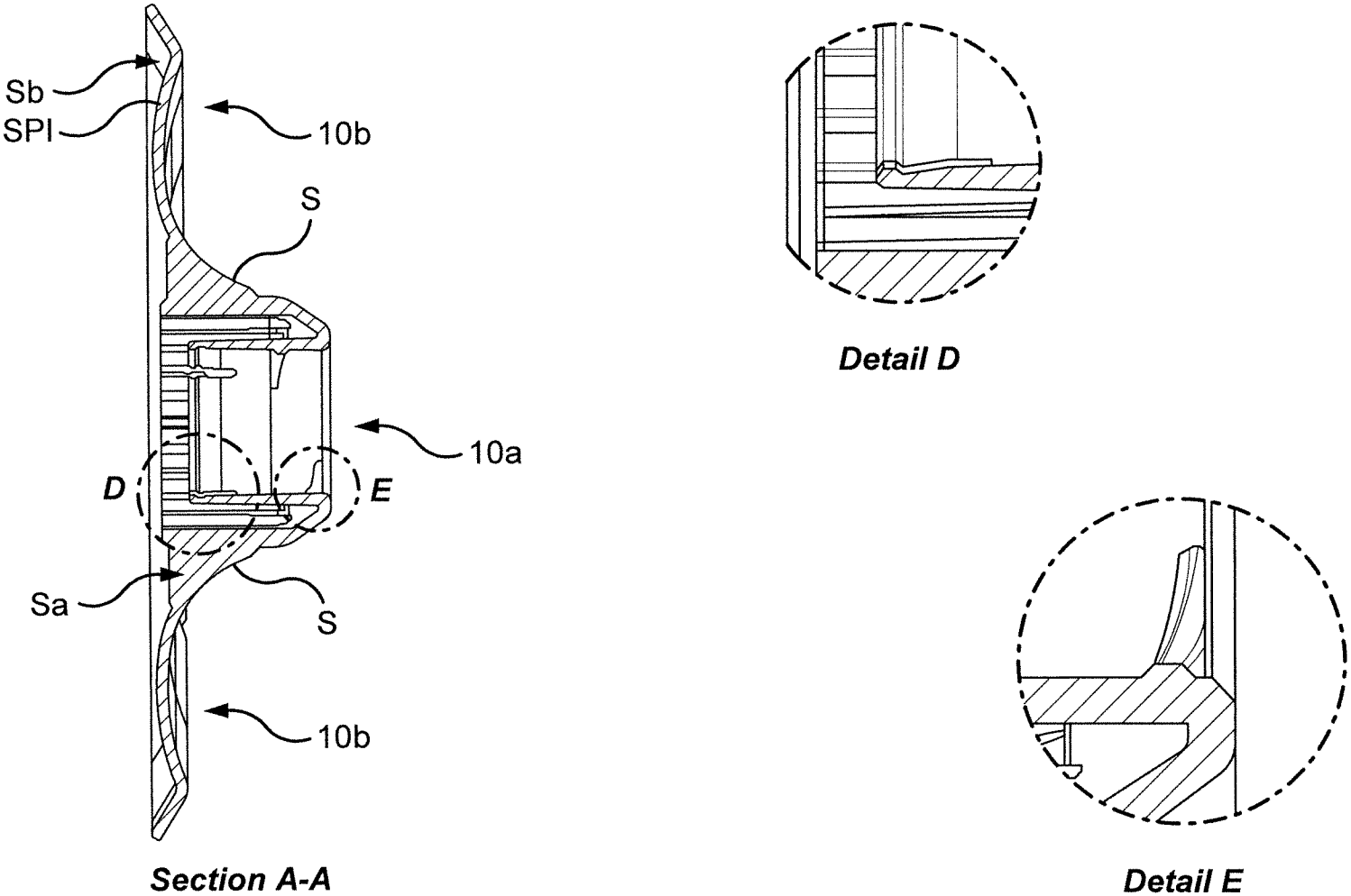
Figure 3:
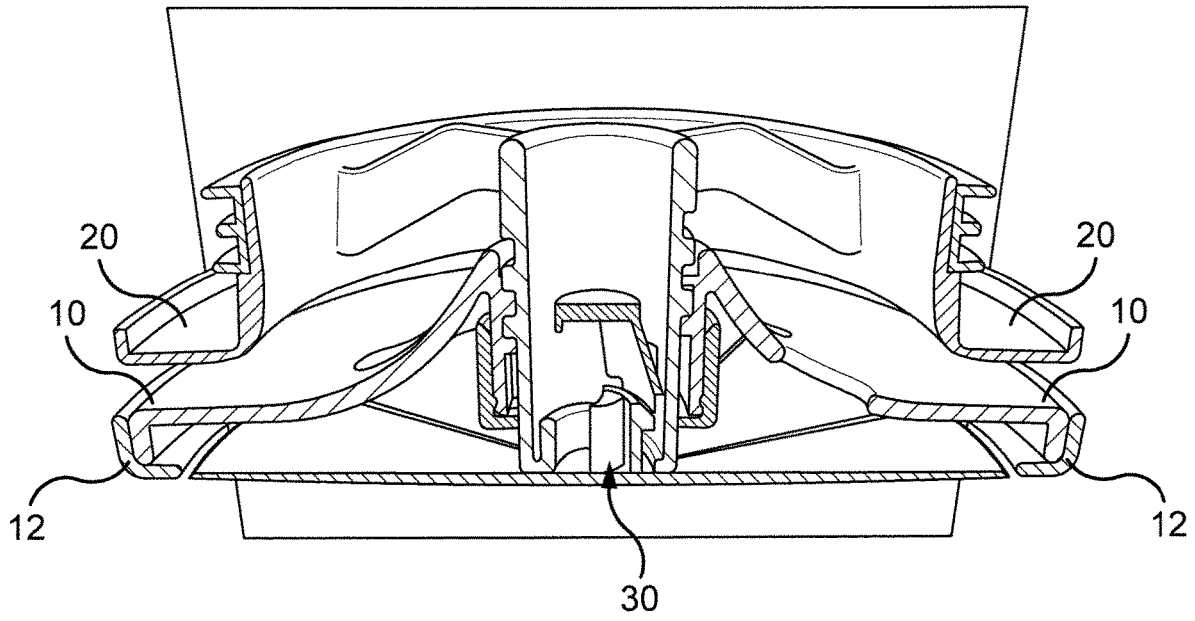
FIGS. 3 to 7 show an embodiment similar to the preferred embodiment of FIG. 1 highlighting further components and functional elements included in the preferred embodiment of FIG. 1.
Figure 3:
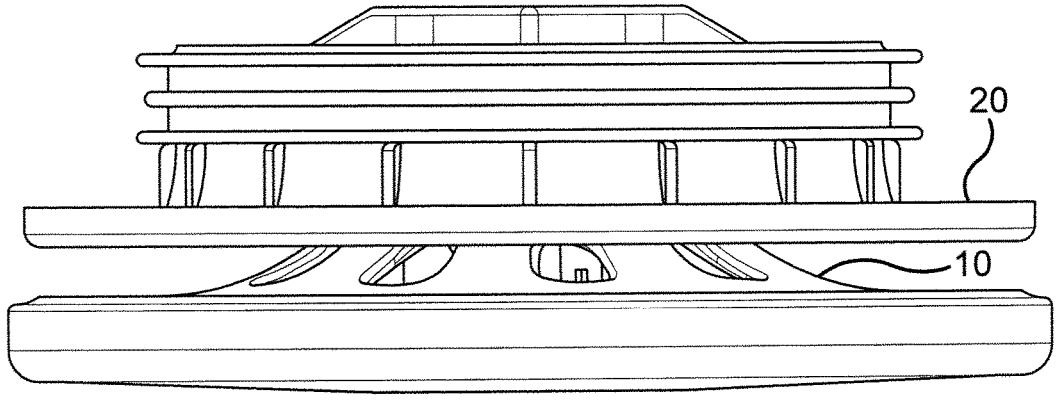
Figure 4:
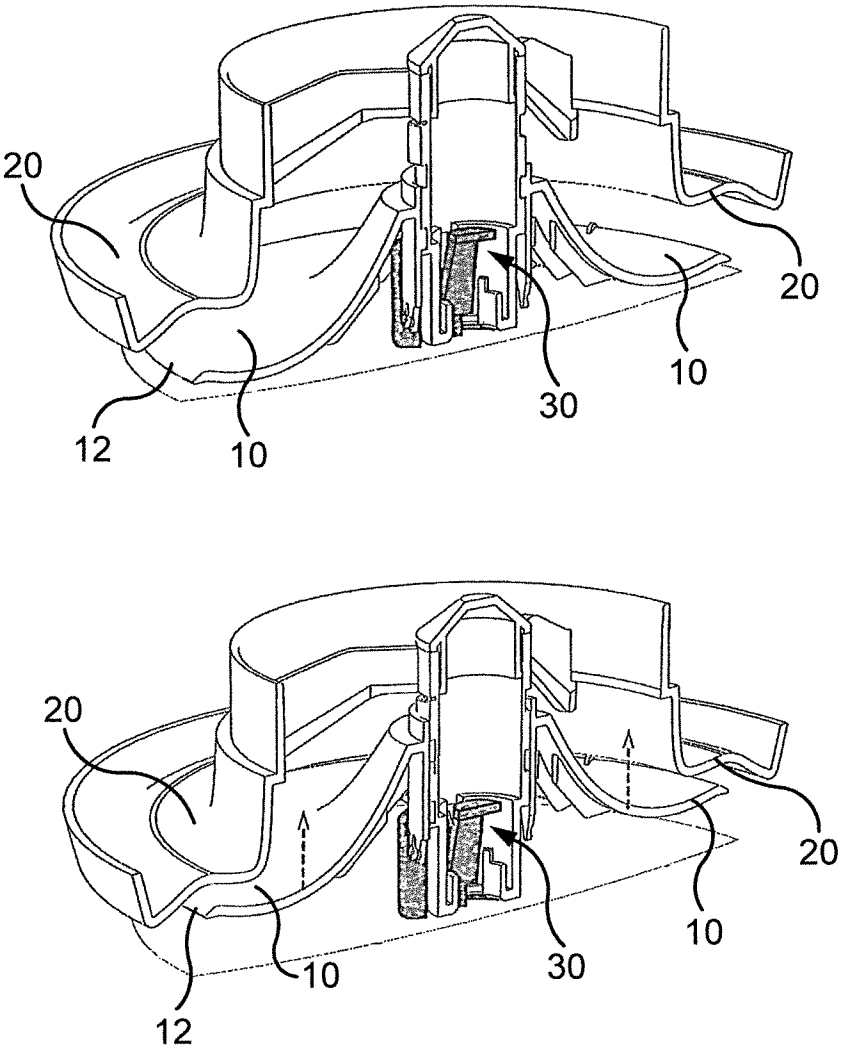
Figure 5:
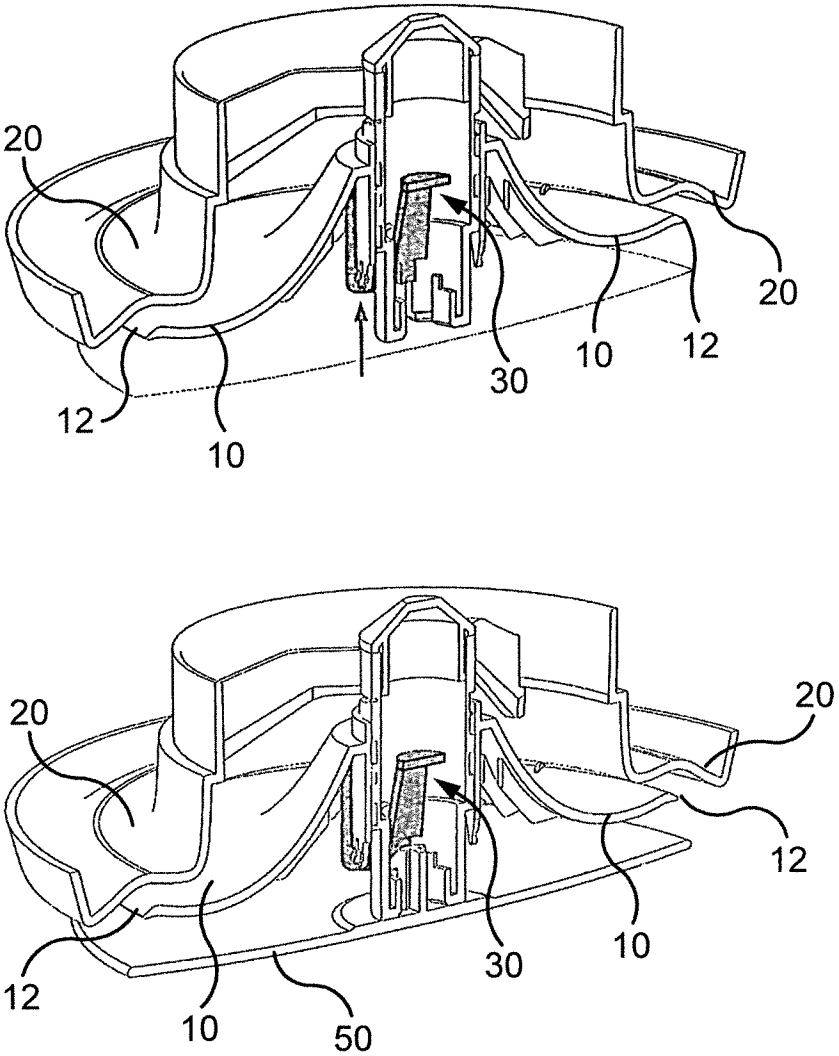

In FIG. 2, the first baffle element 10 is shown in more detail. The baffle element 10 comprises peripherally open slits or grooves 11 which are open at the peripheral edge 12/13 of said baffle element 10. In addition, the peripheral edge 12/13 of said baffle element 10 has indentations 14. A contour or contour line S of said baffle element 10 along a radial direction from the central region 10*a* to the peripheral region 10*b* of said baffle element 10 has a point of inflection SPI defining a change in curvature from a radially internal curvature region Sa to a radially external oppositely curved curvature region Sb of said baffle element 10. The contour S of said baffle element 10 along a radial direction from the central region 10*a* to the peripheral region 10*b* of said baffle element 10 is substantially S-shaped.

In FIGS. 3 to 7, an embodiment similar to the preferred embodiment of FIG. 1 is shown highlighting an adjustment and locking element 30 for locking the adjusted axial spacing (distance) between said second baffle element 20 and said first baffle element 10.

Figure 6:
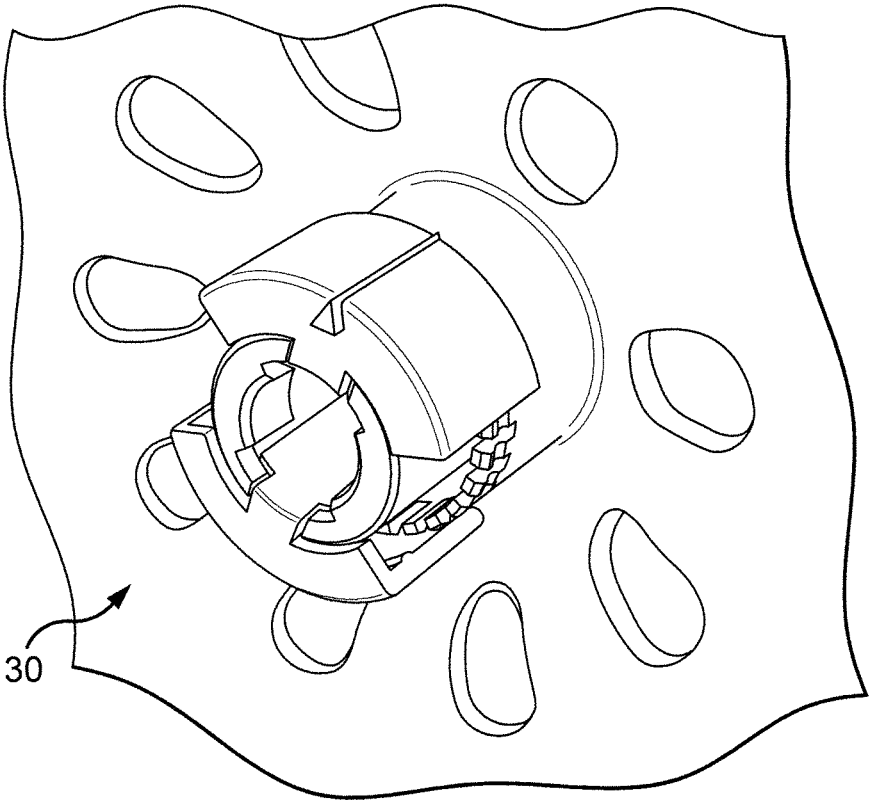
Figure 7:
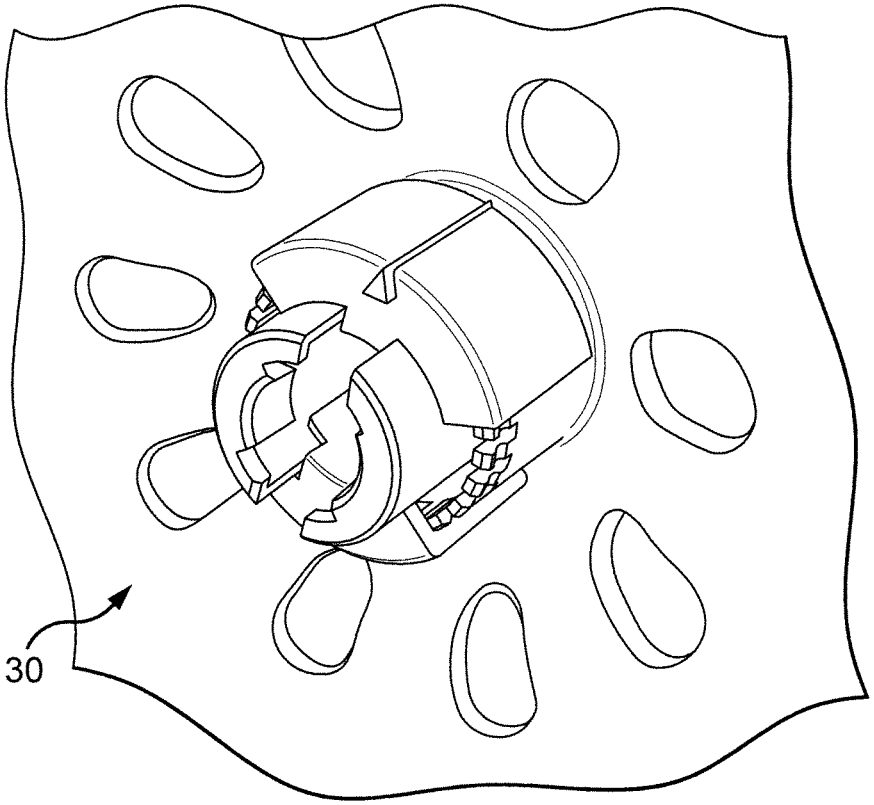

FIGS. 6 and 7 show the locking mechanism in a locked an unlocked position, respectively.

REFERENCE NUMERALS

1 air diffuser device
10 (first) baffle element
10*a* central region
10*b* peripheral region/periphery
11 slots or grooves
12 peripheral edge
13 peripheral edge
14 indentations
20 second baffle element
30 adjustment and locking element
40 fan element
41 first fan blade
42 second fan blade
43 third fan blade
50 cover plate
S contour line S of said baffle element
Sa radially internal curvature region
Sb radially external oppositely curved curvature region
SPI point of inflection

The invention claimed is:

1. An air diffuser device (1) for ventilating rooms and to be installed in a ventilation duct opening in a wall or ceiling of a room, said air diffuser device (1) comprising:

a baffle element (10) having a radius and having a central region (10*a*) and a peripheral region (10*b*) with a peripheral edge (12; 13) configured for deviating at least a part of a ventilation air flow entering said room through said ventilation duct opening in a flow direction with an air flow component parallel to said wall or ceiling, wherein said baffle element (10) comprises a plurality of slits (11) each extending from the central region (10*a*) of said baffle element (10) to the peripheral region (10*b*) of said baffle element (10), wherein the slits are open at the peripheral edge of said baffle element, and wherein said baffle element has a contour along a radial direction from the central region to the peripheral region of said baffle element and has a point of inflexion defining a change in curvature from a radially internal curvature region to a radially external oppositely curved curvature region of said baffle element, the curvature faces inwardly in the central region so a concavity faces the air inlet on one side of the point of inflexion and the curvature faces outwardly in the peripheral region so a convexity faces ground in the mounted state on an opposite side of the point of inflexion, wherein the peripheral edge (13) of said baffle element (10) has a plurality of radially extending indentations (14) spaced from each other along the periphery of said baffle element (10);

wherein said indentations are spaced at regular or irregular intervals along the periphery of said baffle element.

2. The air diffuser device according to claim 1, wherein the peripheral edge of said baffle element has a sawtooth shaped contour.

3. The air diffuser device according to claim 1, wherein the peripheral edge of said baffle element has a sinusoidally-shaped contour.

4. The air diffuser device according to claim 1, wherein said indentations form a contour line extending along the circumference of the baffle element, the maximum depth of said indentations being between 1/60 and 1/10 of said baffle element radius.

5. The air diffuser device according to claim 4, wherein the maximum depth of said indentations is between 1/50 and 1/30 of the radius of the baffle element.

6. The air diffuser device according to claim 1, said air diffuser device further comprising a mounting element for mounting said baffle element to a ventilation duct.

7. The air diffuser device according to claim 6, wherein said mounting element and said baffle element are connected to each other in the central region and/or in the peripheral region of said baffle element.

8. The air diffuser device according to claim 7, wherein said mounting element and said baffle element are formed integrally.

9. The air diffuser device according to claim 7, wherein said mounting element has first formations and said baffle element has second formations, said first and second formations being complementary to each other for connecting said baffle element to said mounting element, wherein said mounting element and said baffle element are connected adjustably with respect to each other.

10. The air diffuser device according to claim 1, wherein the contour of said baffle element is substantially S-shaped.

11. The air diffuser device according to claim 1, wherein the point of inflexion is located at a radial position along the baffle element contour, wherein a length in the radial direction of the radially external oppositely curved curvature region of said baffle element is less than a length in the radial direction of a radial extension of the radially internal curvature region of said baffle element.

12. The air diffuser device according to claim 11, wherein the radial extension of the radially external oppositely curved curvature region of said baffle element is between 1/8 and 1/4 of the radial extension of the radially internal curvature region of said baffle element.

13. The air diffuser devise of claim 11 wherein the point of inflexion is located at the radial position along the baffle element contour such that the radial extension of the radially external oppositely curved curvature region of said baffle element is between 1/10 and 1/3 of the radial extension of the radially internal curvature region of said baffle element.

14. The air diffuser device (1) according to claim 1, wherein said baffle element (10) is a first baffle element (10) and said air diffuser device (1) further comprises a second baffle element (20) located at a position upstream of said first baffle element (10).

15. The air diffuser device according to claim 14, wherein the axial spacing between said second baffle element and said first baffle element is adjustable.

16. The air diffuser device according to claim 1, wherein the slits are open only at the peripheral edge of said baffle element.

17. An air diffuser device for ventilating rooms and to be installed in a ventilation duct opening in a wall or ceiling of a room, said air diffuser device comprising:

a first baffle element having a radius and having a central region and a peripheral region with a peripheral edge configured for deviating at least a part of a ventilation air flow entering said room through said ventilation duct opening in a flow direction with an air flow component parallel to said wall or ceiling, wherein said first baffle element comprises a plurality of slits each extending from the central region of said first baffle element to the peripheral region of said first baffle element, wherein the slits are open at the peripheral edge of said baffle element;

a second baffle element located at a position upstream and of said first baffle element, wherein the second baffle element is arranged above the first baffle element to define a gap;

wherein said first baffle element has a contour along a radial direction from the central region to the peripheral region of said first baffle element has a point of inflexion defining a change in curvature from a radially internal region to a radially external region oppositely curved curvature region of said first baffle element, wherein the curvature faces inwardly in the radially internal region so a concavity faces the air inlet on one side of the point of inflexion and the curvature faces outwardly in the radially external region so a convexity faces ground in the mounted state on an opposite side of the point of inflexion, wherein the peripheral edge (13) of said first baffle element (10) has a plurality of radially extending indentations (14) spaced from each other along the periphery of said first baffle element (10);

wherein said indentations are spaced at regular or irregular intervals along the periphery of said first baffle element.

18. An air diffuser device (1) for ventilating rooms and to be installed in a ventilation duct opening in a wall or ceiling of a room, said air diffuser device (1) comprising:

a baffle element (10) having a radius and having a central region (10*a*) and a peripheral region (10*b*) with a peripheral edge (12; 13) configured for deviating at least a part of a ventilation air flow entering said room through said ventilation duct opening in a flow direction with an air flow component parallel to said wall or ceiling, wherein said baffle element (10) comprises a plurality of slits (11) each extending from the central region (10*a*) of said baffle element (10) to the peripheral region (10*b*) of said baffle element (10), wherein the slits are open at the peripheral edge of said baffle element, and wherein said baffle element has a contour along a radial direction from the central region to the peripheral region of said baffle element and has a point of inflexion defining a change in curvature from a radially internal curvature region to a radially external oppositely curved curvature region of said baffle element, wherein the curvature faces inwardly in the radially internal curvature region so a concavity faces the air inlet on one side of the point of inflexion and the curvature faces outwardly in the radially external oppositely curved region so a convexity faces ground in the mounted state on an opposite side of the point of inflexion.

* * * * *